US005134115A

United States Patent [19]

Diehl et al.

[11] Patent Number: 5,134,115

[45] Date of Patent: Jul. 28, 1992

[54] CYAN AZAMETHINE DYE-DONOR ELEMENT FOR THERMAL DYE TRANSFER

[75] Inventors: Donald R. Diehl; Steven Evans, both of Rochester, N.Y.

[73] Assignee: Eastman Kodak Company, Rochester, N.Y.

[21] Appl. No.: 606,368

[22] Filed: Oct. 31, 1990

[51] Int. Cl.[5] ..... B41M 5/035; B41M 5/26

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS 2,926,187 2/1960 Melby ..... 503/227
4,695,287 9/1987 Evans et al. ..... 503/227

FOREIGN PATENT DOCUMENTS 2161824 1/1986 United Kingdom ..... 503/227
9002047 3/1990 World Int. Prop. O. ..... 503/227

OTHER PUBLICATIONS

L. Hennig and D. Bendler, Z. Chem., 29, 168 (1989).

*Primary Examiner*—Bruce H. Hess
*Attorney, Agent, or Firm*—Harold E. Cole

[57] ABSTRACT

A dye-donor element for thermal dye transfer comprises a suppport having thereon a dye dispersed in a polymeric binder, the dye comprising a cyan azamethine dye having the formula:

20 Claims, No Drawings

CYAN AZAMETHINE DYE-DONOR ELEMENT FOR THERMAL DYE TRANSFER

This invention relates to azamethine dye-donor elements used in thermal dye transfer which have good hue, dye stability and high transfer densities.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled Apparatus and Method For Controlling A Thermal Printer Apparatus, issued Nov. 4, 1986, the disclosure of which is hereby incorporated by reference.

A problem has existed with the use of certain dyes in dye-donor elements for thermal dye transfer printing. Many of the dyes proposed for use do not have adequate stability to light. Others do not have good hue or yield high transfer densities. It would be desirable to provide dyes which have good light stability, have improved hues and give high transfer densities.

U.S. Pat. No. 2,926,187 relates to azamethine dyes derived from activated propene couplers used for textile dyeing. These dyes, however, are only capable of producing red to magenta shades, as will be shown hereinafter.

In L. Hennig and D. Bendler, Z. Chem., 29, 168 (1989), there is a disclosure of cyan azamethine dyes derived from activated propene couplers. However, there is no teaching that these dyes would be useful in thermal dye transfer imaging.

In WO 9002047, there is a disclosure of cyan azamethine dyes derived from certain activated propene couplers for use in thermal transfer imaging. These dyes, however, have poor light stability, as will be shown hereinafter.

In U.S. Pat. No. 4,695,287 and GB 2,161,824, there is a disclosure of azamethine cyan dyes derived from phenolic and naphtholic couplers for use in thermal transfer imaging. These dyes, however, yield relatively poor transfer densities, as will be shown hereinafter.

It would be desirable to provide azamethine dyes for thermal dye transfer imaging which give high transfer densities, have improved hues and good stability to heat and light.

Substantial improvements in light stability, transfer density and hues are achieved in accordance with this invention which comprises a dye-donor element for thermal dye transfer comprising a support having thereon a dye dispersed in a polymeric binder, the dye comprising a cyan azamethine dye having the formula:

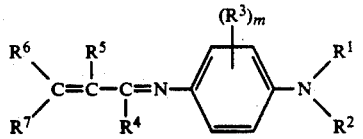

wherein:

$R^1$ and $R^2$ each independently represents hydrogen; an alkyl group having from 1 to about 6 carbon atoms; a cycloalkyl group having from about 5 to about 7 carbon atoms; allyl; an aryl group having from about 6 to about 10 carbon atoms; or hetaryl; or such alkyl, cycloalkyl, allyl, aryl or hetaryl groups substituted with one or more groups such as alkyl, aryl, alkoxy, aryloxy, amino, halogen, nitro, cyano, thiocyano, hydroxy, acyloxy, acyl, alkoxycarbonyl, aminocarbonyl, alkoxycarbonyloxy, carbamoyloxy, acylamido, ureido, imido, alkylsulfonyl, arylsulfonyl, alkylsulfonamido, arylsulfonamido, alkylthio, arylthio, trifluoromethyl, etc., e.g., methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, cyclohexyl, cyclopentyl, phenyl, pyridyl, naphthyl, thienyl, pyrazolyl, p-tolyl, p-chlorophenyl, m-(N-methyl-sulfamoyl)-phenylmethyl, methylthio, butylthio, benzylthio, methanesulfonyl, pentanesulfonyl, methoxy, ethoxy, 2-methane-sulfonamidoethyl, 2-hydroxyethyl, 2-cyanoethyl, methoxycarbonyl-methyl, imidazolyl, naphthyloxy, furyl, p-tolylsulfonyl, p-chlorophenylthio, m-(N-methyl sulfamoyl)phenoxy, ethoxycarbonyl, methoxyethoxycarbonyl, aryloxycarbonyl, carbonyl, acetyl, benzoly, N,N-dimethylcarbamoyl, dimethylamino, morpholino, anilino, pyrrolidino etc.;

or $R^1$ and $R^2$ can be joined together to form, along with the nitrogen to which they are attached, a 5- to 7-membered heterocyclic ring such as morpholine or pyrrolidine;

or either or both of $R^1$ and $R^2$ can be combined with $R^3$ to form a 5- to 7-membered heterocyclic ring;

each $R^3$ independently represents substituted or unsubstituted alkyl, cycloalkyl, allyl, aryl or hetaryl as described above for $R^1$ and $r^2$; alkoxy, aryloxy, halogen, nitro, cyano, thiocyano, hydroxy, acyloxy, acyl, alkoxycarbonyl, aminocarbonyl, alkoxycarbonyloxy, carbamoyloxy, acylamido, ureido, imido, alkylsulfonyl, arylsulfonyl, alkylsulfonamido, arylsulfonamido, alkylthio, arylthio or trifluoromethyl;

or any two of $R^3$ may be combined together to form a 5- or 6-membered carbocyclic or heterocyclic ring;

or one or two of $R^3$ may be combined with either or both of $R^1$ and $R^2$ to complete a 5- to 7 membered ring;

m is an integer of from 0 to 4;

$R^4$ represents hydrogen; a substituted or unsubstituted alkyl, aryl or hetaryl group as described above for $R^1$ and $R^2$; or an electron withdrawing group such as cyano, alkoxycarbonyl, aminocarbonyl, alkylsulfonyl, arylsulfonyl, acyl, nitro, etc.;

$R^5$ represents a substituted or unsubstituted alkyl, aryl or hetaryl group as described above for $R^1$ and $R^2$, or an electron withdrawing group such as those described above for $R^4$;

$R^6$ and $R^7$ each independently represents an electron withdrawing group such as those described above for $R^4$;

$R^5$ and $R^6$ may be combined to form a 5-to 7-membered ring; and $R^6$ and $R^7$ may be combined to form the residue of an active methylene compound such as a pyrazolin-5-one, a pyrazoline-3,5-dione, a thiohydantoin, a barbituric acid, a rhodanine, a furanone, an indandione, etc.

In a preferred embodiment of the invention, $R^4$, $R^6$ and $R^7$ are cyano. In another preferred embodiment, $R^1$ is $C_2H_5$, $C_2H_4OH$, or n-$C_3H_7$. In yet another preferred embodiment, $R_2$ is $C_2H_5$ or n-$C_3H_7$. In yet still another preferred embodiment, $R_3$ is hydrogen, $OC_2H_5$, $CH_3$ or $NHCOCH_3$. In another preferred embodiment, $R^5$ is $C_6H_5$, p-$C_6H_4Cl$, m-$C_6H_4NO_2$ or $C_{10}H_7$.

Compounds included within the scope of the invention include the following:

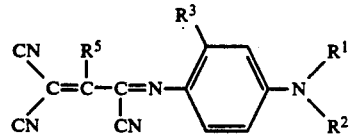

| Compound | $R^1$ | $R^2$ | $R^3$ | $R^5$ |
|---|---|---|---|---|
| 1 | $C_2H_5$ | $C_2H_5$ | $CH_3$ | $C_6H_5$ |
| 2 | $C_2H_5$ | $C_2H_5$ | H | $C_6H_5$ |
| 3 | $C_2H_4OH$ | $C_2H_5$ | $CH_3$ | $C_6H_5$ |
| 4 | $C_2H_5$ | $C_2H_5$ | $OC_2H_5$ | $C_6H_5$ |
| 5 | n-$C_3H_7$ | n-$C_3H_7$ | $NHCOCH_3$ | $C_6H_5$ |
| 6 | $C_2H_5$ | $C_2H_5$ | $CH_3$ | o-$C_6H_4OCH_3$ |
| 7 | $C_2H_5$ | $C_2H_5$ | $CH_3$ | p-$C_6H_4OCH_3$ |
| 8 | $C_2H_5$ | $C_2H_5$ | $CH_3$ | p-$C_6H_4Cl$ |
| 9 | $C_2H_5$ | $C_2H_5$ | $CH_3$ | m-$C_6H_4NO_2$ |
| 10 | $C_2H_5$ | $C_2H_5$ | $CH_3$ | 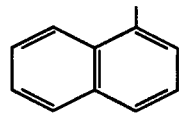 |
| 11 | $C_2H_5$ | $C_2H_5$ | $CH_3$ | 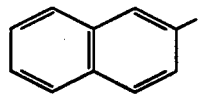 |
| 12 | $C_2H_5$ | $C_2H_5$ | $CH_3$ | 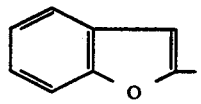 |
| 13 | $C_2H_5$ | $C_2H_5$ | H | 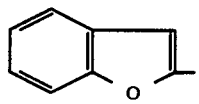 |
| 14 | $C_2H_5$ | $C_2H_5$ | $CH_3$ | p-$C_6H_4F$ |
| 15 | $C_2H_5$ | $C_2H_5$ | $CH_3$ | o-$C_6H_4Cl$ |
| 16 | $C_2H_5$ | $C_2H_5$ | $CH_3$ | p-$C_6H_4CN$ |
| 17 | $C_2H_5$ | $C_2H_5$ | $CH_3$ | 3,4-$C_6H_3Cl_2$ |
| 18 | $C_2H_5$ | $C_2H_5$ | $CH_3$ | 2,4-$C_6H_3Cl_2$ |
| 19 | $C_2H_5$ | $C_2H_5$ | $CH_3$ | 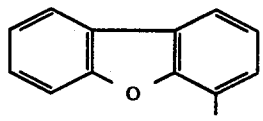 |
| 20 | $C_2H_5$ | $C_2H_5$ | $CH_3$ | 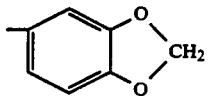 |
| 21 | $C_2H_5$ | $C_2H_5$ | $CH_3$ | 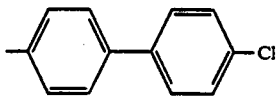 |

-continued
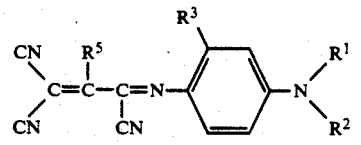
| | | | | |
|---|---|---|---|---|
| 22 | $C_2H_4OH$ | $C_2H_5$ | $CH_3$ | p-$C_6H_4Cl$ |
| 23 | $C_2H_4NH—SO_2CH_3$ | $C_2H_5$ | $CH_3$ | p-$C_6H_4Cl$ |
| 24 | n-$C_3H_7$ | n-$C_3H_7$ | $OC_2H_5$ | $C_2H_5$ |
25
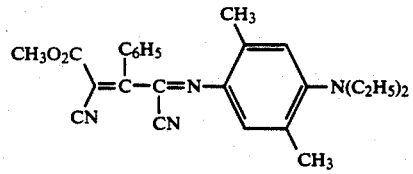
26
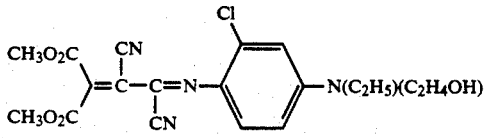
27
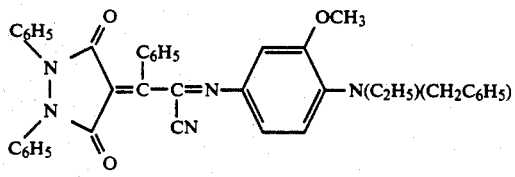
28
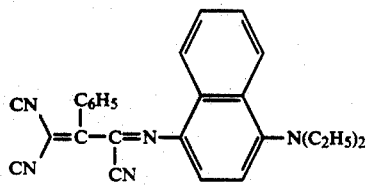
29
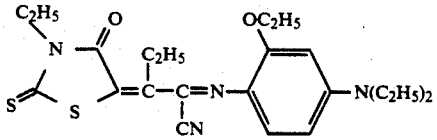
30
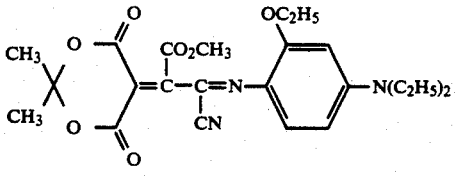
31
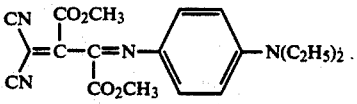
32
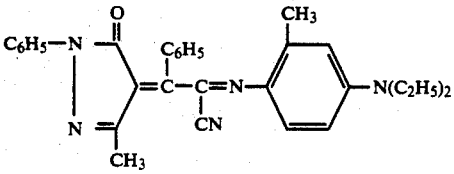

-continued

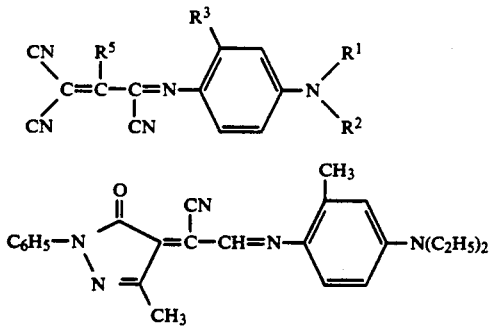

33

The above dyes may be prepared analogous to the method described in Example 1 below.

A dye-barrier layer may be employed in the dye-donor elements of the invention to improve the density of the transferred dye. Such dye-barrier layer materials includes hydrophilic materials such as those described and claimed in U.S. Pat. No. 4,716,144 by Vanier, Lum and Bowman.

The dye in the dye-donor of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate; poly(styrene-co-acrylonitrile); a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the laser or thermal head. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 $\mu$m. It may also be coated with a subbing layer, if desired, such as those materials described in U.S. Pat. Nos. 4,695,288 or 4,737,486.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as duPont Tyvek®. Pigmented supports such as white polyester (transparent polyester with white pigment incorporated therein) may also be used.

The dye image-receiving layer may comprise, for example, a polycarbonate, a polyurethane, a polyester, polyvinyl chloride, poly(styrene-co-acrylonitrile), poly(caprolactone), a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,541,830, 4,698,651, 4,695,287, 4,701,439, 4,757,046, 4,743,582, 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate)

support coated with sequential repeating areas of magenta, yellow and a dye as described above which is of cyan hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material, such as carbon black, cyanine infrared absorbing dyes as described in DeBoer application Ser. No. 463,095, filed Jan. 10, 1990, or other materials as described in the following U.S. application Ser. Nos.: 366,970, 367,062, 366,967, 366,968, 366,969, 367,064, 367,061, 369,494, 366,952, 369,493, 369,492, and 369,491, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in copending U.S. application Ser. No. 451,656 of Baek and DeBoer, filed Dec. 18, 1989, the disclosure of which is hereby incorporated by reference.

Spacer beads may be employed in a separate layer over the dye layer of the dye-donor in the above-described laser process in order to separate the dye-donor from the dye-receiver during dye transfer, thereby increasing the uniformity and density of the transferred image. That invention is more fully described in U.S. Pat. No. 4,772,582, the disclosure of which is hereby incorporated by reference. Alternatively, the spacer beads may be employed in the receiving layer of the dye-receiver as described in U.S. Pat. No. 4,876,235, the disclosure of which is hereby incorporated by reference. The spacer beads may be coated with a polymeric binder if desired.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Synthesis of Compound 1

A. Synthesis of 2-phenyl-1,1,3-tricyano-propene (intermediate for Compound 1)

A mixture of benzoylacetonitrile (9.94 g, 0.0685 mole), malononitrile (11.3 g, 0.17 mole), ammonium acetate (5.4 g, 0.07 mole) and ethanol (100 mL) was heated at reflux for 1.5 hours. After cooling to room temperature, the reaction mixture was diluted with water (50 mL) and concentrated hydrochloric acid (7.5 mL) was added dropwise over 5 minutes. The resulting precipitate was collected by filtration and washed with water and ligroin. The yield was 10.0 g (76%), m.p. 92°-98° C.

B. Synthesis of Compound 1: 2-phenyl-1,1,3-tricyano-3-(4-diethylamino-2-methylphenylimino)-propene

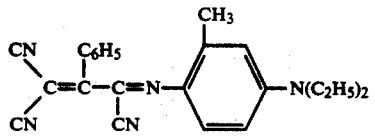

A mixture of the phenyltricyanopropene above (0.58 g, 0.003 mole) and 2-amino-5-diethyl-aminotoluene hydrochloride (0.64 g, 0.003 mole) in a solution of methanol (30 mL) and water (10 mL) was treated with concentrated ammonium hydroxide (1.8 mL). To this mixture was slowly added a solution of potassium ferricyanide (4.94 g, 0.015 mole) in water (20 mL), keeping the temperature below 20° C. with external cooling. After stirring for 2 hours, the reaction mixture was diluted with water (100 mL) and the resulting precipitate was collected by filtration and washed well with water. The crude dye was crystallized from methanol to yield 0.85 g (81%) of a dark green powder.

EXAMPLE 2

A known weight (approximately 1 mg) of dye as identified in Table 1 was dissolved in sufficient acetone to provide a solution of 0.01 g dye/L. A spectrum of this solution was obtained on a recording spectrophotometer, the absorption maximum and absorbance were recorded and the molar extinction coefficient (liters/mole-cm) ($e \times 10^{-4}$) was calculated from the formula:

$$e = (absorbance \times molecular\ wt.\ of\ dye \times 100)$$

TABLE 1

| Cmpd. | Absorption Maximum (nm) | Extinction Coefficient ($e \times 10^{-4}$) |
|---|---|---|
| 1 | 604 | 4.4 |
| 2 | 598 | 5.4 |
| 3 | 606 | 4.5 |
| 4 | 601 | 5.2 |
| 5 | 630 | 6.3 |
| 6 | 609 | 4.4 |
| 7 | 598 | 4.5 |
| 8 | 611 | 4.9 |
| 9 | 602 | 5.2 |
| 10 | 614 | 5.1 |
| 11 | 607 | 4.8 |
| 12 | 617 | 3.9 |
| 13 | 608 | 3.7 |
| 14 | 606 | 4.7 |
| 15 | 607 | 4.7 |
| 16 | 604 | 5.0 |
| 17 | 611 | 5.1 |
| 18 | 604 | 5.5 |
| 19 | 611 | 4.8 |
| 20 | 603 | 4.5 |
| 21 | 610 | 4.7 |
| 22 | 611 | 4.6 |
| 23 | 601 | 4.4 |
| 32 | 586 | 2.6 |
| C-1 | 658 | 2.6 |
| C-2 | 663 | 2.9 |
| C-3 | 578 | 1.6 |
| C-4 | 527 | 4.5 |
| C-5 | 612 | 4.8 |
| C-6 | 632 | 5.2 |

The structures of the control dyes are as follows:

C-1

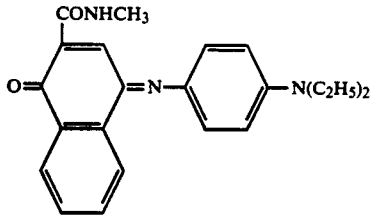

U.S. Pat. No. 4,695,287, Compound 1

C-2

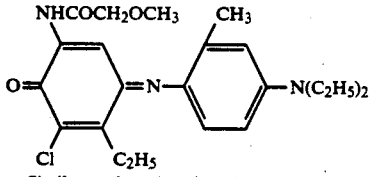

Similar to dyes described in G.B. Patent 2,161,824,

-continued

C-3

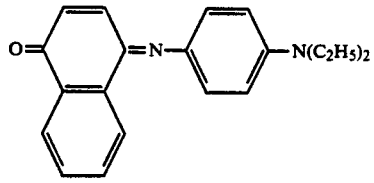

U.S. Pat. No. 4,695,287, Control Compound 4

C-4

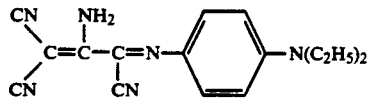

U.S. Pat. No. 2,926,187, Example 1

C-5

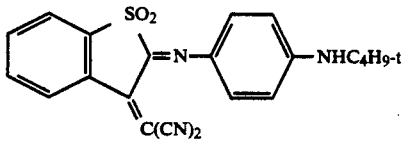

Similar to dyes disclosed in W090-02047

C-6

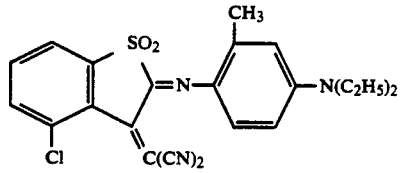

Similar to dyes disclosed in W090-02047

The above results indicate that the dyes of the invention in general are either of superior cyan hue (absorption maximum at higher wavelength, thus less bluish hue) or have a higher extinction coefficient (more intense absorption) for a given weight of dye. While controls C-5 and C-6 have good cyan hue and high extinction coefficients, they have poor light stability as will be shown hereinafter in Example 4.

EXAMPLE 3

Individual cyan dye-donor elements were prepared by coating on a 100 μm poly(ethylene terephthalate) support:

1) a subbing layer of poly(acrylonitrile-co-vinylidene chloride-co-acrylic acid) (0.054 g/m$^2$) (14:79:7 wt. ratio); and
2) a dye layer containing each of the cyan dyes identified below and illustrated above, (0.27 g/m$^2$) and the cyanine infrared absorbing dye illustrated below (0.054 g/m$^2$) in a cellulose acetate propionate binder (2.5% acetyl, 45% propionyl) (0.27 g/m$^2$) coated from dichloromethane.

Cyanine Infrared Absorbing Dye

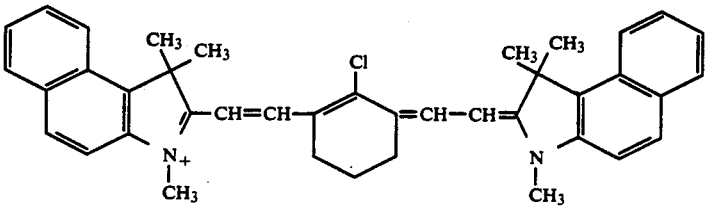

-continued

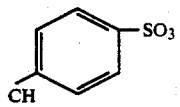

Intermediate dye-receiving elements were prepared by coating on an unsubbed 100 μm thick poly(ethylene terephthalate) support a layer of crosslinked poly(styrene-co-divinylbenzene) beads (14 micron average diameter) (0.11 g/m²), triethanolamine (0.09 g/m²) and DC-510® Silicone Fluid (Dow Corning Company) (0.01 g/m²) in a Butvar® 76 binder, a poly(vinyl alcohol-co-butyral), (Monsanto Company) (3.2 g/m²) from a 1,1,2-trichloroethane and dichloromethane solvent mixture.

Single color stepped images of cyan dye were printed as described below from dye-donors onto a receiver using a laser imaging device as described in U.S. Pat. No. 4,876,235. The laser imaging device consisted of a single diode laser connected to a lens assembly mounted on a translation stage and focused onto the dye-donor layer.

The dye-receiving element was secured to the drum of the diode laser imaging device with the receiving layer facing out. The dye-donor element was secured in face-to-face contact with the receiving element.

The diode laser used was a Spectra Diode Labs No. SDL-2430-H2, having an integral, attached optical fiber for the output of the laser beam, with a wavelength of 816 nm and a nominal power output of 250 milliwatts at the end of the optical fiber. The cleaved face of the optical fiber (100 microns core diameter) was imaged onto the plane of the dye-donor with a 0.33 magnification lens assembly mounted on a translation stage giving a nominal spot size of 33 microns and a measured power output at the focal plane of 115 milliwatts.

The drum, 312 mm in circumference, was rotated at 500 rpm and the imaging electronics were activated. The translation stage was incrementally advanced across the dye-donor by means of a lead screw turned by a microstepping motor, to give a center-to-center line distance of 14 microns (714 lines per centimeter, or 1800 lines per inch). For a continuous tone stepped image, the current supplied to the laser was modulated from full power to 16% power in 4% increments.

After the laser had scanned approximately 12 mm, the laser exposing device was stopped and the receiver was separated from the dye donor. The receiver containing the stepped dye image was laminated to Quintessence® (Potlatch Inc.) 80 pound stock paper by passage through a pair of rubber rollers heated to 120° C. The polyethylene terephthalate support was then peeled away leaving the stepped cyan dye image and polyvinyl alcohol-co-butyral firmly adhered to the paper.

The Status A reflection density of the maximum density of the stepped image was recorded and is tabulated below. All of the dyes of the invention gave bright blue to cyan-hued images of good density.

| Dye in Donor | Status A Red Maximum Transferred Density |
|---|---|
| Compound 5 | 2.3 |
| Compound 8 | 2.2 |
| Compound 9 | 2.1 |
| Compound 10 | 1.9 |

-continued

| Dye in Donor | Status A Red Maximum Transferred Density |
|---|---|
| Compound 11 | 2.1 |

EXAMPLE 4

Individual cyan dye-donor elements were prepared by coating on a 6 μm poly(ethylene terephthalate) support:

1) a subbing layer of Tyzor TBT®, a titanium tetra-n-butoxide, (duPont Company) (0.16 g/m²) coated from 1-butanol; and
2) a dye layer containing each of the cyan dyes identified below and illustrated above, (0.32 mmoles/m²) and FC-431® fluorocarbon surfactant (3M Company) (0.01 g/m²) in a cellulose acetate propionate binder (2.5% acetyl, 45% propionyl) (at 1.5 times the weight of dye) coated from butanone.

On the back side of the dye-donor element was coated:

1) a subbing layer of Tyzor TBT®, a titanium tetra-n-butoxide, (duPont Company) (0.16 g/m²) coated from 1-butanol; and
2) a slipping layer of Emralon 329®, a dry film lubricant of poly(tetrafluoroethylene) particles, (Acheson Colloids Co.) (0.54 g/m²) coated from a n-propyl acetate, toluene, isopropyl alcohol and n-butyl alcohol solvent mixture.

Control dye-donors each with the cyan dye identified below (0.32 mmoles/m²) were also prepared.

Dye-receiving elements were prepared by coating the following layers in order on white-reflective supports of titanium dioxide pigmented polyethylene overcoated paper stock:

(1) A subbing layer of poly(acrylonitrile-co-vinylidene chloride-co-acrylic acid) (14:79:7 wt. ratio) (0.08 g/m²) coated from butanone solvent, and
(2) A dye-receiving layer of Fluorad FC-431® (a perfluorosulfonamido surfactant of 3M Corp.) (0.02 g/m²), Makrolon 5700®, a bisphenol-A polycarbonate of Bayer AG, (2.9 g/m²) and polycaprolactone (0.81 g/m²) coated from dichloromethane solvent.

The dye side of the dye-donor element approximately 10 cm×15 cm in area was placed in contact with the polymeric receiving layer side of the dye-receiver element of the same area. The assemblage was fastened to the top of a motor-driven 60 mm diameter rubber roller and a TDK Thermal Head L-231 (No. 6-2R16-1), thermostatted at 26° C., was pressed with a spring at a force of 36 Newtons against the dye-donor element side of the assemblage pushing it against the rubber roller.

The imaging electronics were activated and the assemblage was drawn between the printing head and roller at 6.9 mm/sec. Coincidentally, the resistive elements in the thermal print head were pulsed at 128 μsec intervals (29 μsec/pulse) during the 33 msec/dot printing time. The voltage supplied to the print head was approximately 23.5v resulting in an instantaneous peak power of approximately 1.3 watts/dot and a maximum total energy of 9.6 mjoules/dot. A stepped density image was generated by incrementally increasing the pulses/dot through a defined range to a maximum of 255.

After printing, the donor element was separated from the receiving element and the Status A reflection density of the maximum density of the stepped image was read. Each stepped image was then subjected to exposure for 2 weeks, 5.4 kLux fluorescent light at approximately 25% RH. The densities were then re-read to determine the percent dye loss due to light fade. These values recorded below indicate that the dyes of the invention are superior to prior art dyes for transfer using a thermal head, and in general show dye loss equal or less to prior art dyes.

| Dye in Donor | Status A Red Density | |
|---|---|---|
| | Maximum Transferred | Percent Loss |
| Compound 1 | 1.8 | nd |
| Compound 2 | 1.7 | nd |
| Compound 3 | 1.6 | nd |
| Compound 8 | 2.0 | −4 |
| Compound 9 | 2.0 | −4 |
| C-1 (Control) | 1.0 | −5 |
| C-2 (Control) | 1.3 | −4 |
| C-3 (Control) | 1.0 | −3 |
| C-5 (Control) | 0.9 | −38 |
| C-6 (Control) | 1.9 | −30 |

nd = not determined

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon a dye dispersed in a polymeric binder, the dye comprising a cyan azamethine dye having the formula:

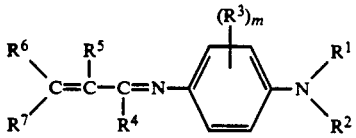

wherein:

$R^1$ and $R^2$ each independently represents hydrogen; a substituted or unsubstituted alkyl group having from 1 to about 6 carbon atoms; a substituted or unsubstituted cycloalkyl group having from about 5 to about 7 carbon atoms; a substituted or unsubstituted allyl group; a substituted or unsubstituted aryl group having from about 6 to about 10 carbon atoms; or a substituted or unsubstituted hetaryl group;

or $R^1$ and $R^2$ can be joined together to form, along with the nitrogen to which they are attached, a 5- to 7-membered heterocyclic ring;

or either or both of $R^1$ and $R^2$ can be combined with $R^3$ to form a 5- to 7-membered heterocyclic ring;

each $R^3$ independently represents a substituted or unsubstituted alkyl group having from 1 to about 6 carbon atoms; a substituted or unsubstituted cycloalkyl group having from about 5 to about 7 carbon atoms; a substituted or unsubstituted allyl group; a substituted or unsubstituted aryl group having from about 6 to about 10 carbon atoms; a substituted or unsubstituted hetaryl group; alkoxy; aryloxy; halogen; nitro; cyano; thiocyano; hydroxy; acyloxy; acyl; alkoxycarbonyl; aminocarbonyl; alkoxycarbonyloxy; carbamoyloxy; acylamido; ureido; imido; alkylsulfonyl; arylsulfonyl; alkylsulfonamido; arylsulfonamido; alkylthio; arylthio or trifluoromethyl;

or any two of $R^3$ may be combined together to form a 5- or 6-membered carbocyclic or heterocyclic ring;

or one or two of $R^3$ may be combined with either or both of $R^1$ and $R^2$ to complete a 5- to 7-membered ring;

m is an integer of from 0 to 4;

$R^4$ represents hydrogen; a substituted or unsubstituted alkyl group having from 1 to about 6 carbon atoms; a substituted or unsubstituted aryl group having from about 6 to about 10 carbon atoms; a substituted or unsubstituted hetaryl group; or an electron withdrawing group;

$R^5$ represents a substituted or unsubstituted alkyl, aryl or hetaryl group, or an electron withdrawing group;

$R^6$ and $R^7$ each independently represents an electron withdrawing group;

$R^5$ and $R^6$ may be combined to form a 5-to 7-membered ring; and $R^6$ and $R^7$ may be combined to form the residue of an active methylene compound.

2. The element of claim 1 wherein $R^4$, $R^6$ and $R^7$ are cyano.

3. The element of claim 1 wherein $R^1$ is $C_2H_5$, $C_2H_4OH$, or n-$C_3H_7$.

4. The element of claim 1 wherein $R^2$ is $C_2H_5$ or n-$C_3H_7$.

5. The element of claim 1 wherein $R^3$ is hydrogen, $OC_2H_5$, $CH_3$ or $NHCOCH_3$.

6. The element of claim 1 wherein $R^5$ is $C_6H_5$, p-$C_6H_4Cl$, m-$C_6H_4NO_2$ or $C_{10}H_7$.

7. The element of claim 1 wherein said support comprises poly(ethylene terephthalate) and the side of the support opposite the side having thereon said dye layer is coated with a slipping layer comprising a lubricating material.

8. The element of claim 1 wherein said dye layer comprises sequential repeating areas of magenta, yellow and said dye which is of cyan hue.

9. In a process of forming a dye transfer image comprising imagewise-heating a dye-donor element comprising a support having thereon a dye layer comprising a dye dispersed in a polymeric binder and transferring a dye image to a dye-receiving element to form said dye transfer image, the improvement wherein said dye comprises a cyan azamethine dye having the formula:

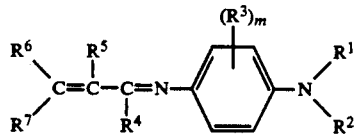

wherein:

$R^1$ and $R^2$ each independently represents hydrogen; a substituted or unsubstituted alkyl group having from 1 to about 6 carbon atoms; a substituted or unsubstituted cycloalkyl group having from about 5 to about 7 carbon atoms; a substituted or unsubstituted allyl group; a substituted or unsubstituted aryl group having from about 6 to about 10 carbon atoms; or a substituted or unsubstituted hetaryl group;

or $R^1$ and $R^2$ can be joined together to form, along with the nitrogen to which they are attached, a 5- to 7-membered heterocyclic ring;

or either or both of $R^1$ and $R^2$ can be combined with $R^3$ to form a 5- to 7-membered heterocyclic ring;

each $R^3$ independently represents a substituted or unsubstituted alkyl group having from 1 to about 6 carbon atoms; a substituted or unsubstituted cycloalkyl group having from about 5 to about 7 carbon atoms; a substituted or unsubstituted allyl group; a substituted or unsubstituted aryl group having from about 6 to about 10 carbon atoms; a substituted or unsubstituted hetaryl group; alkoxy; aryloxy; halogen; nitro; cyano; thiocyano; hydroxy; acyloxy; acyl; alkoxycarbonyl; aminocarbonyl; alkoxycarbonyloxy; carbamoyloxy; acylamido; ureido; imido; alkylsulfonyl; arylsulfonyl; alkylsulfonamido; arylsulfonamido; alkylthio; arylthio or trifluoromethyl;

or any two of $R^3$ may be combined together to form a 5- or 6-membered carbocyclic or heterocyclic ring;

or one or two of $R^3$ may be combined with either or both of $R^1$ and $R^2$ to complete a 5- to 7-membered ring;

m is an integer of from 0 to 4;

$R^4$ represents hydrogen; a substituted or unsubstituted alkyl group having from 1 to about 6 carbon atoms; a substituted or unsubstituted aryl group having from about 6 to about 10 carbon atoms; a substituted or unsubstituted hetaryl group; or an electron withdrawing group;

$R^5$ represents a substituted or unsubstituted alkyl, aryl or hetaryl group, or an electron withdrawing group;

$R^6$ and $R^7$ each independently represents an electron withdrawing group;

$R^5$ and $R^6$ may be combined to form a 5-to 7-membered ring; and $R^6$ and $R^7$ may be combined to form the residue of an active methylene compound.

10. The process of claim 9 wherein $R^4$, $R^6$ and $R^7$ are cyano.

11. The process of claim 9 wherein $R^1$ is $C_2H_5$, $C_2H_4OH$, or n-$C_3H_7$.

12. The process of claim 9 wherein $R^2$ is $C_2H_5$ or n-$C_3H_7$.

13. The process of claim 9 wherein $R^3$ is hydrogen, $OC_2H_5$, $CH_3$ or $NHCOCH_3$.

14. The process of claim 9 wherein $R^5$ is $C_6H_5$, p-$C_6H_4Cl$, m-$C_6H_4NO_2$ or $C_{10}H_7$.

15. The process of claim 9 wherein said support is poly(ethylene terephthalate) which is coated with sequential repeating areas of magenta, yellow and said dye which is of cyan hue, and said process steps are sequentially performed for each color to obtain a three-color dye transfer image.

16. In a thermal dye transfer assemblage comprising:

a) a dye-donor element comprising a support having thereon a dye layer comprising a dye dispersed in a polymeric binder, and b) a dye-receiving element comprising a support having thereon a dye image-receiving layer, said dye-receiving element being in a superposed relationship with said dye-donor element so that said dye layer is in contact with said dye image-receiving layer, the improvement wherein said dye comprises a cyan azamethine dye having the formula:

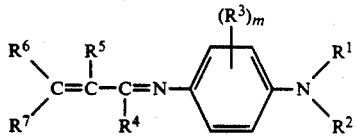

wherein:

$R^1$ and $R^2$ each independently represents hydrogen; a substituted or unsubstituted alkyl group having from 1 to about 6 carbon atoms; a substituted or unsubstituted cycloalkyl group having from about 5 to about 7 carbon atoms; a substituted or unsubstituted allyl group; a substituted or unsubstituted aryl group having from about 6 to about 10 carbon atoms; or a substituted or unsubstituted hetaryl group;

or $R^1$ and $R^2$ can be joined together to form, along with the nitrogen to which they are attached, a 5- to 7-membered heterocyclic ring;

or either or both of $R^1$ and $R^2$ can be combined with $R^3$ to form a 5- to 7-membered heterocyclic ring;

each $R^3$ independently represents a substituted or unsubstituted alkyl group having from 1 to about 6 carbon atoms; a substituted or unsubstituted cycloalkyl group having from about 5 to about 7 carbon atoms; a substituted or unsubstituted allyl group; a substituted or unsubstituted aryl group having from about 6 to about 10 carbon atoms; a substituted or unsubstituted hetaryl group; alkoxy; aryloxy; halogen; nitro; cyano; thiocyano; hydroxy; acyloxy; acyl; alkoxycarbonyl; aminocarbonyl; alkoxycarbonyloxy; carbamoyloxy; acylamido; ureido; imido; alkylsulfonyl; arylsulfonyl; alkylsulfonamido; arylsulfonamido; alkylthio; arylthio or trifluoromethyl;

or any two of $R^3$ may be combined together to form a 5- or 6-membered carbocyclic or heterocyclic ring;

or one or two of $R^3$ may be combined with either or both of $R^1$ and $R^2$ to complete a 5-to 7-membered ring;

m is an integer of from 0 to 4;

$R^4$ represents hydrogen; a substituted or unsubstituted alkyl group having from 1 to about 6 carbon atoms; a substituted or unsubstituted aryl group having from about 6 to about 10 carbon atoms; a substituted or unsubstituted hetaryl group; or an electron withdrawing group;

$R^5$ represents a substituted or unsubstituted alkyl, aryl or hetaryl group, or an electron withdrawing group;

$R^6$ and $R^7$ each independently represents an electron withdrawing group;

$R^5$ and $R^6$ may be combined to form a 5-to 7-membered ring; and $R^6$ and $R^7$ may be combined to form the residue of an active methylene compound.

17. The assemblage of claim 16 wherein $R^4$, $R^6$ and $R^7$ are cyano.

18. The assemblage of claim 16 wherein $R^1$ is $C_2H_5$, $C_2H_4OH$, or n-$C_3H_7$.

19. The assemblage of claim 16 wherein $R^2$ is $C_2H_5$ or n-$C_3H_7$.

20. The assemblage of claim 16 wherein $R^3$ is hydrogen, $OC_2H_5$, $CH_3$ or $NHCOCH_3$ and $R^5$ is $C_6H_5$, p-$C_6H_4Cl$, m-$C_6H_4NO_2$ or $C_{10}H_7$.

* * * * *